United States Patent [19]

Bensing et al.

[11] Patent Number: 4,884,980

[45] Date of Patent: Dec. 5, 1989

[54] INSERT MOLDED MULTIPLE CONTACT ELECTRICAL CONNECTOR

[75] Inventors: Gregory L. Bensing, Cortland; Thomas M. Nadasky, Berlin Center; Raymond C. Wright, Hubbard, all of Ohio

[73] Assignee: General Motors Corporation, Detroit, Mich.

[21] Appl. No.: 144,189

[22] Filed: Jan. 15, 1988

[51] Int. Cl.[4] ..... H01R 13/504

[52] U.S. Cl. ..... 439/606; 439/695

[58] Field of Search ..... 439/449, 597–601, 439/686, 695, 701, 736, 750, 722, 606

[56] References Cited

U.S. PATENT DOCUMENTS

| | | | |
|---|---|---|---|
| 3,668,615 | 6/1972 | Bury | 439/695 |
| 4,043,630 | 8/1977 | Suversion et al. | 439/606 |
| 4,602,830 | 7/1986 | Lockard | 439/736 |
| 4,602,831 | 7/1986 | Lockard | 439/736 |
| 4,655,515 | 4/1987 | Hamsher, Jr. et al. | 439/701 |

*Primary Examiner*—Gary F. Paumen

*Attorney, Agent, or Firm*—F. J. Fodale

[57] ABSTRACT

An insert molded multiple contact electrical connector comprising a molded insert of thermoplastic insulating material having a barrel shaped body which has a plurality of circumferentially spaced grooves and a plurality of cable grips. The cable grips are formed by semicircular grooves in parallel segments of a polygonal flange at one end of the barrel shaped body. A plurality of electrical contacts which are attached to a plurality of electric cables by core and insulation crimp wings are disposed in the grooves and the cable grips respectively to form a subassembly. An outer housing of thermoplastic insulating material is molded over the subassembly in a die which has a plurality of cable grip parts which cooperate with the respective cable grips of the molded insert to retain and seal around the electric cables individually and to space the electric cables from each other when the outer housing of thermoplastic insulating material is molded over the subassembly. The electrical contacts also have tangs which are disposed against the opposite end of the barrel shaped body between axially projecting lugs.

9 Claims, 3 Drawing Sheets

INSERT MOLDED MULTIPLE CONTACT ELECTRICAL CONNECTOR

BACKGROUND OF THE INVENTION

This invention relates generally to electrical connectors and more specifically to insert molded electrical connectors having multiple contacts.

Insert molded electrical connectors as the name implies comprise an outer molded housing of insulating material and an insert which is placed in the mold when the outer insulator housing is molded. The insert is generally molded from a thermoplastic insulating material and the usual function of the insert is to hold the electric contacts in the desired position in the final mold.

The electric contacts themselves may be insert molded in the insert and the resulting subassembly then molded over with an outer housing of insulating material as in the case of the household type plug which is disclosed in U.S. Pat. No. 3,093,434 granted to Wallace R. Francis June 11, 1963. Such a construction is perfectly acceptable in a household or similar environment.

On the other hand the electrical contacts may be loaded into a premolded insert and the resulting subassembly then molded over with an outer housing of insulating material for example as disclosed in U.S. Pat. No. 3,945,708 granted to Richard H. Griffin Mar. 23, 1976 or U.S. Pat. No. 4,043,630 granted to Lyle B. Suverison and William R. Beck Aug. 23, 1977. These type constructions are generally used for electrical connectors having several electrical contacts which are used in harsher environments.

In either case it is difficult to provide a good seal between the electric cables attached to the electrical contacts and the outer molded insulator housing particularly when the electrical connector has several electric cables and is going to be used in a harsh environment such as the engine compartment of an automobile.

SUMMARY OF THE INVENTION

The object of this invention is to provide an insert molded multiple contact electrical connector which has a good seal between the electric cables and the outer molded insulator housing.

A feature of the invention is that the electric cables are individually sealed in the outer molded insulator housing to improve the quality of the seal.

Another feature of the invention is that the mold insert assists in individually sealing at least some of the electric cables when the outer insulator housing is molded over the subassembly comprising the electrical contacts and the mold insert.

Another feature of the invention is that the mold insert has a portion which serves as one part of the mold cable grip when the outer insulator housing is molded over the subassembly comprising the electrical contacts and mold insert.

Yet another feature of the invention is that the individually sealed electric cables are located on several segments of the mold insert to increase the density of the electrical contacts.

Yet another feature of the invention is that the individually sealed electric cables are located on several parallel segments of the mold insert to accommodate a circular array of electrical contacts arranged by the mold insert in a subassembly which can be easily molded over to provide an insulator housing.

Still yet another feature of the invention is that the mold insert has shoulders which cooperate with metal tangs of the electric contact to accurately locate the electrical contacts in the axial direction during the final molding process.

Still yet another feature of the invention is that the mold insert accommodates electric contacts which include both core and insulation crimp wings which are attached to the electric cables to provide strain relief during and after the final molding process.

Other objects and features of the invention will become apparent to those skilled in the art as disclosure is made in the following detailed description of a preferred embodiment of the invention which sets forth the best mode of tne invention contemplated by the inventors and which is illustrated in the accompanying sheets of drawing.

DETAILED DESCRIPTION OF THE PREFERRED EMBODIMENT

Figure 1:
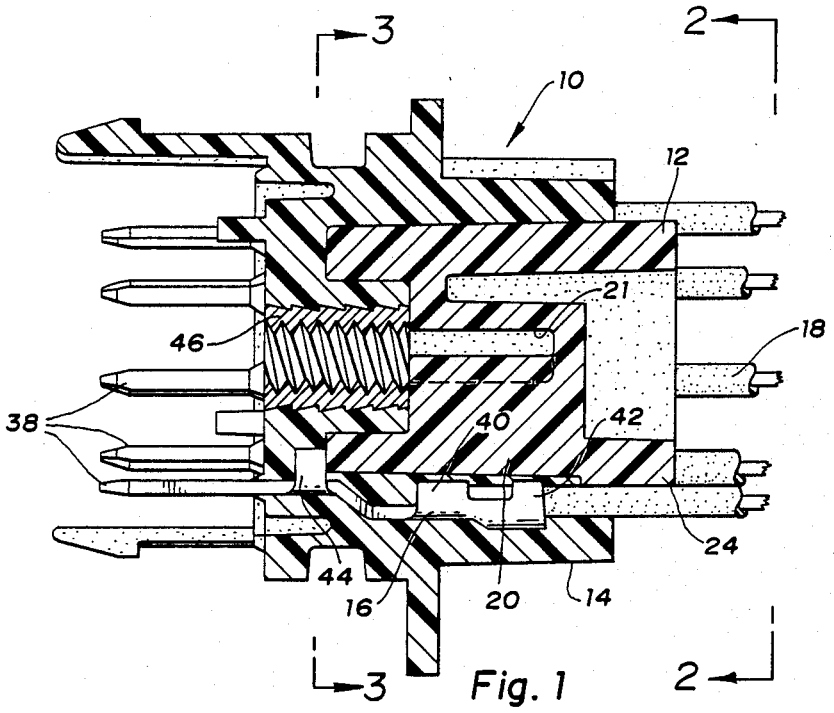
FIG. 1 is an axial cross sectional view of an insert molded multiple contact electrical connector in accordance with the invention.

Referring now to the drawing the electrical connector 10 comprises a mold insert 12 and a molded over housing 14 of insulating material for a plurality of electrical contacts or terminals 16 which are attached to electric cables 18.

Figure 5:
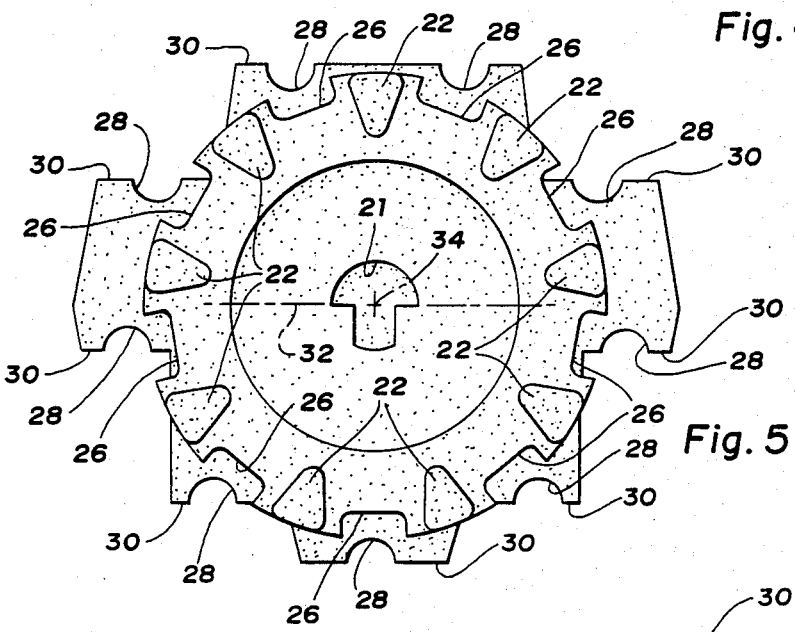
FIG. 5 is a front end view of the mold insert taken substantially along the line 5—5 of FIG. 4 looking in the direction of the arrows.
Figure 6:
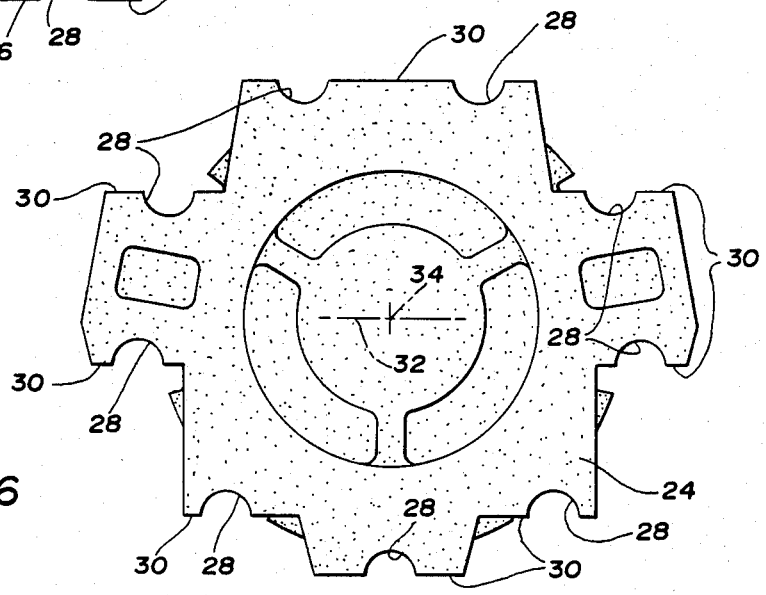
FIG. 6 is a rear end view of the mold insert taken substantially along the line 6—6 of FIG. 4 looking in the direction of the arrows.

The mold insert 12 is premolded from a suitable thermoplastic insulating material such as nylon. It comprises a barrel shaped body 20 which has a concentric pilot hole 21, a plurality of circumferentially spaced triangular lugs 22 at its forward end and a polygonal flange 24 at its rearward end. The outer wall of the barrel shaped body 20 has a plurality of circumferentially spaced axial grooves 26 which are rectangular in cross section. The triangular lugs 22 and axial grooves 26 in the outer wall of the barrel shaped body 20 are interspersed with each other as best shown in FIG. 5.

The polygonal flange 24 also has a plurality of circumferential spaced grooves 28. The grooves 28 are semicircular in cross section and the grooves 28 are aligned with the rectangular grooves 26 of the body 20 in the radial direction as best shown in FIG. 5. The rim of the polygonal flange 24 includes several parallel segments 30 which are parallel to an imaginary center plane 32 which contains the centerline 34 of the mold insert 12 and divides the mold insert 12 in half in the axial direction. The semicircular grooves 28 are located in these parallel segments 30 of the rim to provide one part of the cable grips for the final molding process as explained in more detail later on.

The electric contacts 16 are male terminals having contact blades 38 at one end and core and insulation crimp wings 40 and 42 at the other end for attaching the electric contacts 16 to the electric cables 18 in a conventional manner. The electric contacts 16 also include intermediate metal tangs 44.

Figure 7:
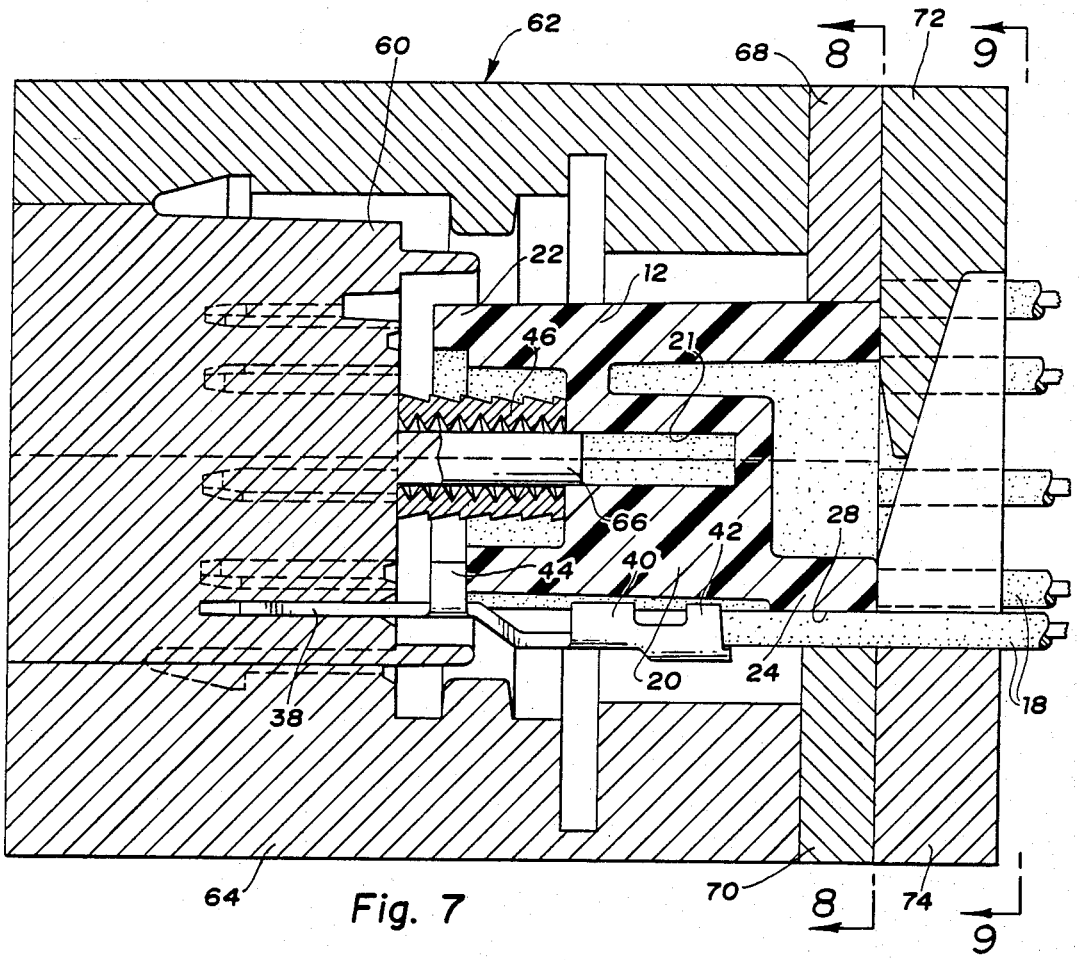
FIG. 7 is an axial cross sectional view showing the mold insert and electrical contacts of the insert molded multiple contact electrical connector of FIG. 1 disposed in a mold for molding the outer housing of insulating material.

The electrical connector 10 is constructed in a three part die which comprises a stationary mandrel 60 and upper and lower moveable dies 62 and 64 which move from an open position (not shown) toward each other to a closed position which is shown in FIG. 7. The upper and lower dies 62 and 64 are opened and the electric con'acts 16 are loaded into the die by inserting the contact blades 38 in axial slots in the stationary mandrel 60. A brass coupling 46 is then loaded onto a pilot pin 66 of the mandrel 60. The brass coupling 46 which has a threaded bore is used to fasten the electrical connector 10 to a mating electrical connector (not shown). The brass coupling 46 is also used during the final molding process to locate the mold insert 12 in the die in the axial direction.

The mold insert 12 is then loaded onto the pilot pin 66 in an oriented position where the centerplane 32 lies on the parting line of the moveable upper and lower die halves 62 and 64 and where each of the electric contacts 16 is disposed in one of the rectangular grooves 26 and the attached electric cable 18 is disposed in the associated semicircular groove 28 in one of the parallel segments 30 in the rim of the polygonal flange 24. In this oriented position, the metal tangs 44 of the electric contacts 16 are disposed against the face of the barrel shaped body 20 between the triangular lugs 22.

Figure 8:
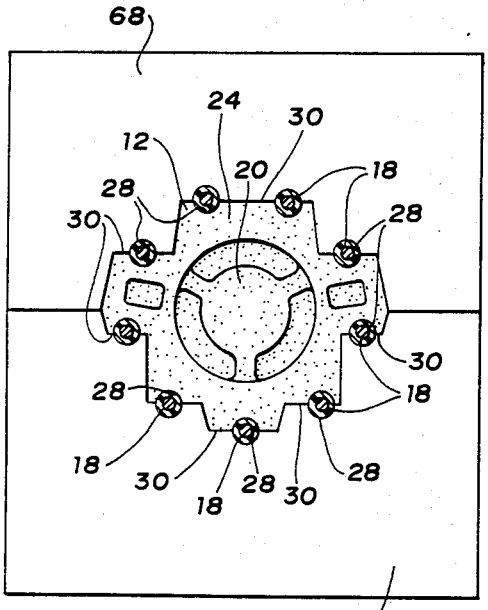
FIG. 8 is a section view of the mold taken substantially along the line 8—8 of FIG. 7 looking in the direction of the arrows.
Figure 9:
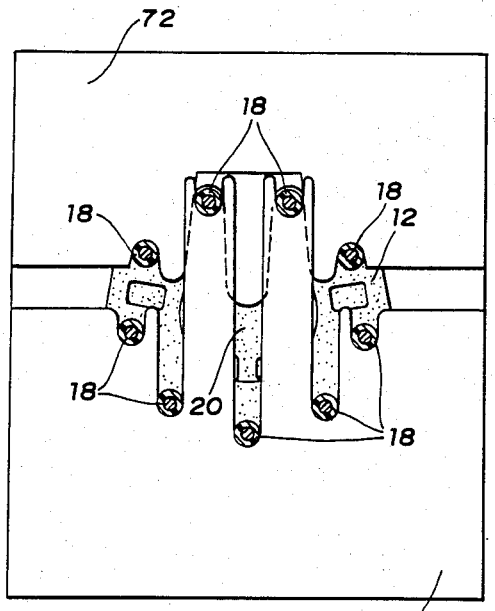
FIG. 9 is a rear end view of the mold taken substantially along the line 9—9 of FIG. 7 looking in the direction of the arrows.

The upper and lower moveable dies 62 and 64 are then closed. The moveable dies 62 and 64 each include respective cable grip plates 68 and 70 and respective holder plates 72 and 74. The cable grip plates 68 and 70 cooperate with the polygonal flange 24 of the mold insert 12 to individually retain the electric cables 18 and to space the electric cables 18 from each other during the final molding process. More particularly the upper grip plate 68 has four cable grip portions comprising semicircular grooves in parallel segments which mate with the four grip portions of the polygonal flange 24 which are formed by the four semicircular grooves 28 in the four parallel segments 32 which are above the centerplane 34 as shown in FIG. 8. Similarly the lower grip plate 70 has five cable grip portions which mate with the five grip portions of the polygonal flange 24 which are formed by the five semicircular grooves 28 in the parallel segments 32 which are below the centerplane 34.

The holder plates 72 and 74 are finger like and project inwardly between the cables 18 when the moveable dies 62 and 64 are closed engaging the rear end surface of the mold insert 12 to push and hold the mold insert 12 forward against the brass coupling 46 and the mandrel 60 for the final molding process.

Figure 2:
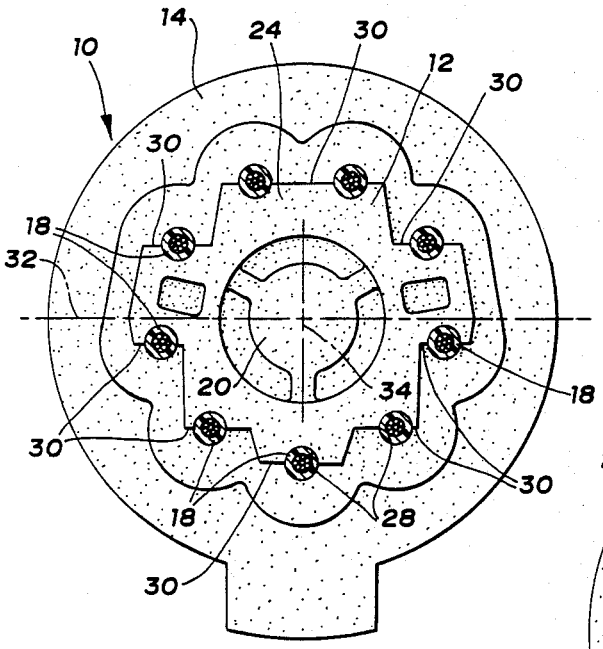
FIG. 2 is a rear end view of the electrical connector taken substantially along the line 2—2 of FIG. 1 looking in the direction of the arrows.
Figure 3:
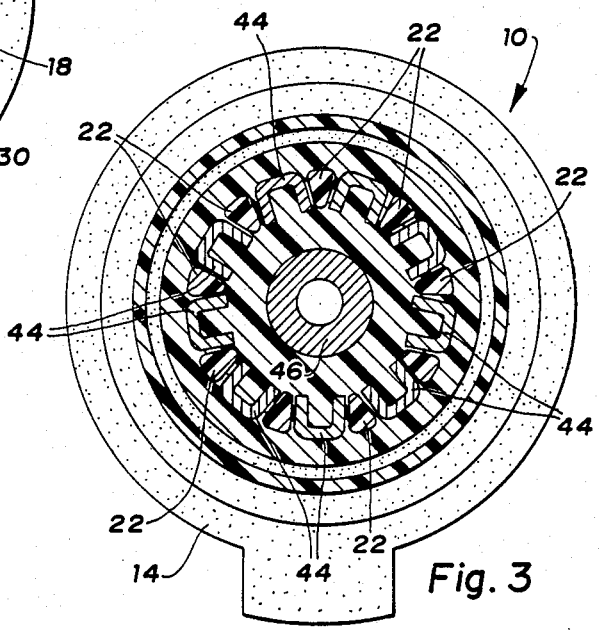
FIG. 3 is a section view of the electrical connector taken substantially along the line 3—3 of FIG. 1 looking in the direction of the arrows.
Figure 4:
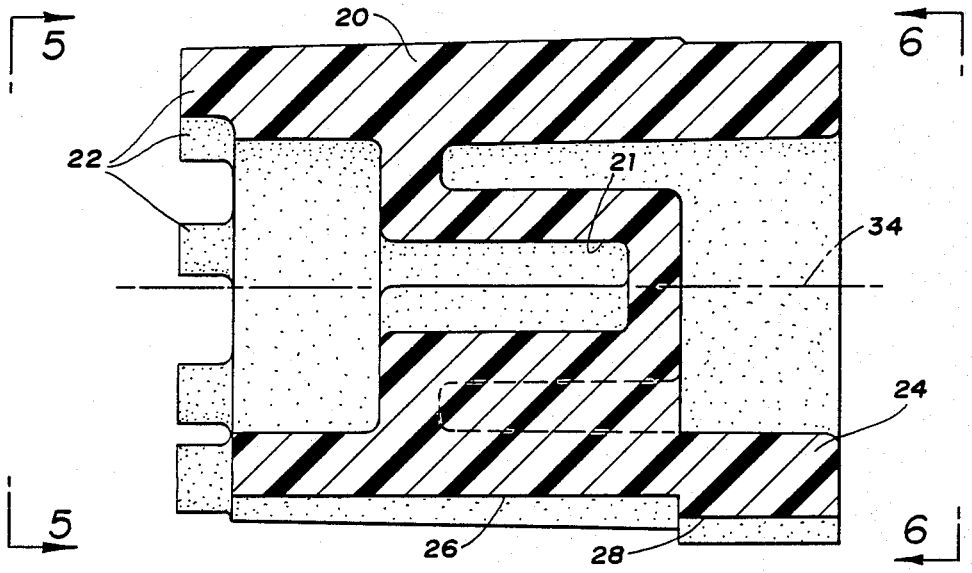
FIG. 4 is an axial cross sectional view of a mold insert for the insert molded multiple contact electrical connector shown in FIGS. 1, 2 and 3.

After the upper and lower dies are closed the outer housing 14 is molded from a suitable insulating thermoplastic material such as nylon. The completed electrical connector 10 is shown in FIGS. 1, 2 and 3 where it should be noted that the rear portion of the polygonal flange 24 of the mold insert 12 which provided the stationary part of the cable grips for the final molding process is exposed. Consequently the material chosen for the mold insert 12 should be capable of withstanding the same environment as the insulator housing 14.

We wish it to be understood that we do not desire to be limited to the exact details of construction shown and described, for obvious modifications will occur to a person skilled in the art.

The embodiments of the invention in which an exclusive property or privilege is claimed are defined as follows:

1. An electrical connector comprising:
   - a molded insert of thermoplastic insulating material having a body which has a groove and a cable grip at one end which is aligned with the groove,
   - an electrical contact which is attached to an electric cable, said electrical contact and said electric cable being disposed in the groove and the cable grip respectively to form a subassembly, and
   - an outer housing of thermoplastic insulating material which is molded over the subassembly in a die which has a cable grip part which cooperates with the cable grip of the molded insert to retain and seal around the electric cable when the outer housing of thermoplastic insulating material is molded over the subassembly whereby the molded insert has a portion of the cable grip which is exposed after the outer housing has been molded over the subassembly.

2. A multiple contact electrical connector comprising:
   - a molded insert of thermoplastic insulating material having a body which has a plurality of grooves and a plurality of cable grips at one end which are aligned with the respective grooves,
   - a plurality of electrical contacts which are attached to a plurality of electric cables respectively, said electrical contacts and said electric cables being disposed in the grooves and the cable grips respectively to form a subassembly, and
   - an outer housing of thermoplastic insulating material which is molded over the subassembly in a die which has a plurality of cable grip parts which cooperate with the respective cable grips of the molded insert to retain and seal around the electric cables individually and to space the electric cables from each other when the outer housing of thermoplastic insulating material is molded over the subassembly whereby the molded insert has a portion each of the cable grips which is exposed after the outer housing has been molded over the subassembly.

3. The electrical connector as defined in claim 2 wherein the cable grips of the molded insert are formed by semicircular grooves which are disposed in a plurality of parallel segments at the one end of the molded insert.

4. The electrical connector as defined in claim 2 wherein the body has a polygonal flange at the one end which includes a plurality of parallel segments and the cable grips of the molded insert are formed by semicircular grooves which are disposed in the parallel segments.

5. The electrical connector as defined in claim 4 wherein the molded insert has an imaginary centerplane and the parallel segments are parallel to and spaced from the imaginary centerplane.

6. A multiple contact electrical connector comprising:

a molded insert of thermoplastic insulating material having a barrel shaped body which has a plurality of circumferentially spaced rectangular grooves and a polygonal flange at one end which has a plurality of parallel segments which are parallel to an imaginary centerplane of the molded insert, said polygonal flange having a plurality of semicircular grooves which are disposed in the plurality of parallel segments and respectively aligned with the plurality of rectangular grooves to provide a plurality of cable grips at one end of the molded insert which are aligned with the respective rectangular grooves in the body of the molded insert, a plurality of electrical contacts which are attached to a plurality of electric cables respectively, said electrical contacts and said electric cables being disposed in the rectangular grooves of the body and the semicircular grooves of the cable grips respectively to form a subassembly, and an outer housing of thermoplastic insulating material which is molded over the subassembly in a die which has a plurality of cable grip parts which cooperate with the respective cable grips of the molded insert to retain and seal around the electric cables individually and to space the electric cables from each other when the outer housing of thermoplastic insulating material is molded over the subassembly whereby the molded insert has a portion each of the cable grips which is exposed after the outer housing has been molded over the subassembly.

7. The electrical connector as defined in claim 6 wherein the molded insert has a plurality of lugs which extend axially outward from an end of the body which is opposite the end having the polygonal flange, wherein the lugs are interspersed with the rectangular grooves of the body and wherein the electric contacts have tangs which are disposed against the end of the body of the molded insert between the axially projecting lugs.

8. The electrical connector as defined in claim 6 wherein the electrical contacts have core and insulation crimp wings which attach the electrical contacts to the electric cables and which fit into the rectangular grooves of the barrel shaped body of the molded insert.

9. The electrical connector as defined in claim 7 wherein the electrical contacts have core and insulation crimp wings which attach the electrical contacts to the electric cables and which fit into the rectangular grooves of the barrel shaped body of the molded insert.

* * * * *